United States Patent [19]

Yasuhara

[11] Patent Number: 4,567,868

[45] Date of Patent: Feb. 4, 1986

[54] FUEL INJECTION SYSTEM FOR AN INTERNAL COMBUSTION ENGINE

[75] Inventor: Seishi Yasuhara, Yakosuka, Japan

[73] Assignee: Nissan Motor Company, Limited, Japan

[21] Appl. No.: 650,885

[22] Filed: Sep. 17, 1984

[30] Foreign Application Priority Data

Sep. 30, 1983 [JP] Japan ..... 58-180660

[51] Int. Cl.[4] ..... F02B 3/00

[52] U.S. Cl. ..... 123/300; 123/449; 123/503

[58] Field of Search ..... 123/299, 300, 449, 503, 123/502; 417/289, 282, 294

[56] References Cited

U.S. PATENT DOCUMENTS

| | | | |
|---|---|---|---|
| 2,356,627 | 8/1944 | Skaredoff | 123/300 |
| 3,404,668 | 10/1968 | Eheim et al. | 123/449 |
| 4,224,903 | 9/1980 | Mowbray | 123/300 |
| 4,294,210 | 10/1981 | Bassoli et al. | 123/300 |
| 4,470,760 | 9/1984 | Jarrett et al. | 123/300 |

FOREIGN PATENT DOCUMENTS

| | | | |
|---|---|---|---|
| 3013088 | 10/1981 | Fed. Rep. of Germany | 123/503 |
| 12049 | 2/1981 | Japan | 123/503 |
| 172453 | 10/1983 | Japan | 123/449 |

*Primary Examiner*—Magdalen Y. C. Moy

*Attorney, Agent, or Firm*—Lowe, King, Price & Becker

[57] ABSTRACT

In a fuel injection system, as an engine crankshaft rotates twice, a working chamber contracts and expands a number of times equal to twice the number of engine combustion chambers. Each time the working chamber expands, fuel is conducted to the working chamber. During alternate contractions of the working chamber, fuel is directed from the working chamber toward each of the combustion chambers in sequence to be injected thereinto at a first timing. During the intervening contractions of the working chamber, fuel is directed from the working chamber toward each of the combustion chambers in sequence to be injected thereinto at a second timing. The second timing follows the first timing by a fraction of at least one operating stroke of the engine. In another fuel injection system of this invention, fuel is periodically injected into an engine combustion chamber at a first timing with respect to rotation of the engine crankshaft. Fuel is also periodically injected into the combustion chamber at a second timing with respect to rotation of the crankshaft. The quantity of fuel injected at the first timing increases to a preset maximum level as the quantity of fuel injected at the second timing increases to a predetermined level. The first timing fuel quantity remains at the preset maximum level as the second timing fuel quantity increases from the predetermined level.

17 Claims, 7 Drawing Figures

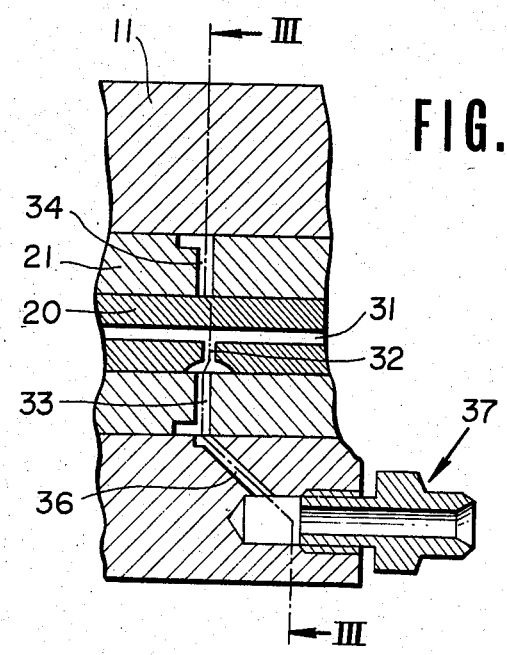
FIG.2
FIG.3
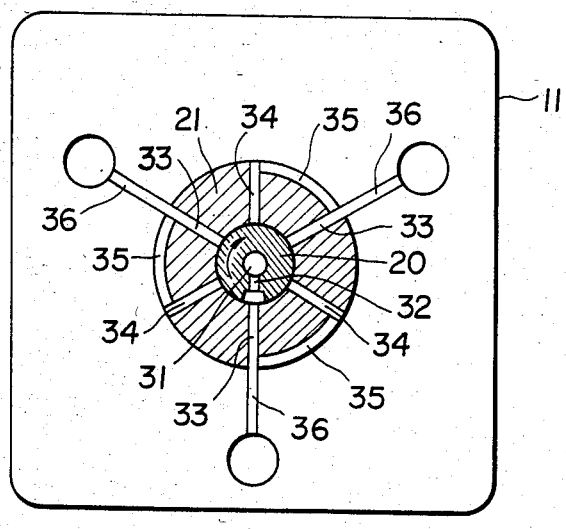

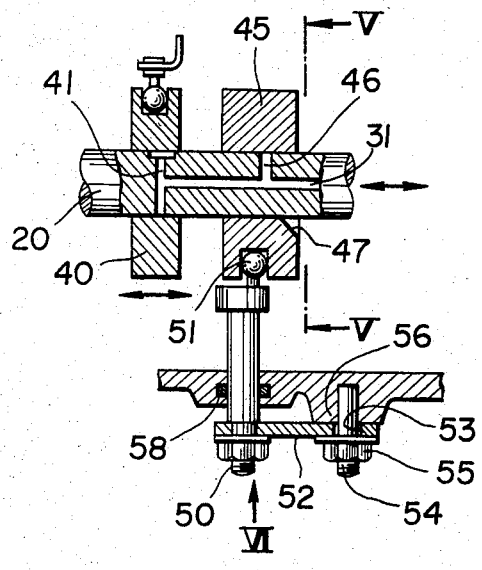
FIG.4
FIG.5
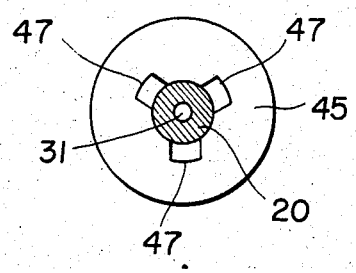
FIG.6
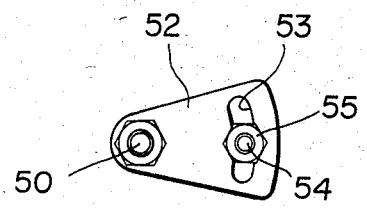
FIG.7
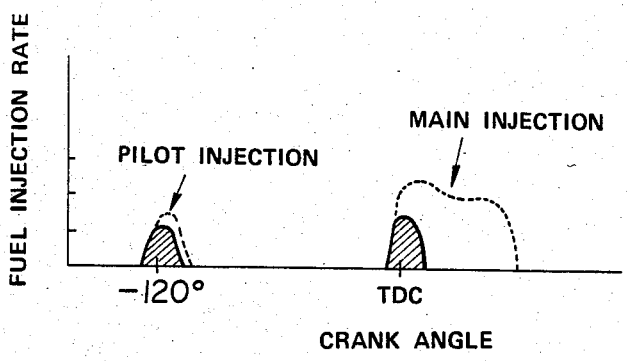

FUEL INJECTION SYSTEM FOR AN INTERNAL COMBUSTION ENGINE

BACKGROUND OF THE INVENTION

1. Field of the Invention

This invention relates to a fuel injection system for an internal combustion engine, such as a diesel engine.

2. Description of the Prior Art

Diesel engines are susceptible to noisy combustion or detonation. This is caused by ignition lag resulting in the supply of an excessive quantity of fuel into combustion chambers prior to complete ignition.

Some fuel injection systems provide pilot fuel injection in advance of the main charge of fuel. The pilot charge of fuel facilitates ignition of the main charge of fuel, thereby reducing ignition lag and preventing noisy combustion and detonation.

Japanese patent publication 56-56962 discloses one such fuel injection system. In application of this injection system to a three-cylinder engine, pilot fuel charge occurs at an unacceptable timing, specifically at a point during the air intake stroke excessively remote from the compression stroke. For best results, the timing of pilot fuel injection should reside essentially within the compression stroke.

SUMMARY OF THE INVENTION

It is an object of this invention to provide a fuel injection system for an internal combustion engine which performs pilot fuel injection at an acceptable timing even in cases where the engine has a small number of cylinders, such as in three-cylinder engines.

In a fuel injection system of this invention, a working chamber contracts and expands a number of times equal to twice the number of engine combustion chambers for every two rotations of the engine crankshaft. Each time the working chamber expands, fuel is conducted to the working chamber. During alternate contractions of the working chamber, fuel is directed from the working chamber toward each of the combustion chambers in sequence to be injected thereinto at a first timing. During the intervening contractions of the working chamber, fuel is directed from the working chamber toward each of the combustion chambers in sequence to be injected thereinto at a second timing. The second timing follows the first timing by a fraction of at least one operating stroke of the engine.

In another fuel injection system of this invention, fuel is periodically injected into an engine combustion chamber at a first timing with respect to rotation of the engine crankshaft. Fuel is also periodically injected into the combustion chamber at a second timing with respect to rotation of the crankshaft. The quantity of fuel injected at the first timing increases to a preset maximum level as the quantity of fuel injected at the second timing increases to a predetermined level. The first timing fuel quantity remains at the preset maximum level as the second timing fuel quantity increases from the predetermined level.

BRIEF DESCRIPTION OF THE DRAWINGS

FIG. 2 is an enlarged view of the plunger, the barrel, and surrounding elements of FIG. 1.

FIG. 3 is a sectional view taken along the line III—III of FIG. 2.

FIG. 4 is an enlarged view of the plunger, the main control sleeve, the pilot control sleeve, and neighboring elements of FIG. 1.

FIG. 5 is a cross-sectional view taken along the line V—V of FIG. 4.

FIG. 6 is a view in the direction of the arrow VI of FIG. 4.

FIG. 7 is a diagram of the relationship between the fuel injection rate and the crank angle.

DESCRIPTION OF THE PREFERRED EMBODIMENT

Figure 1:
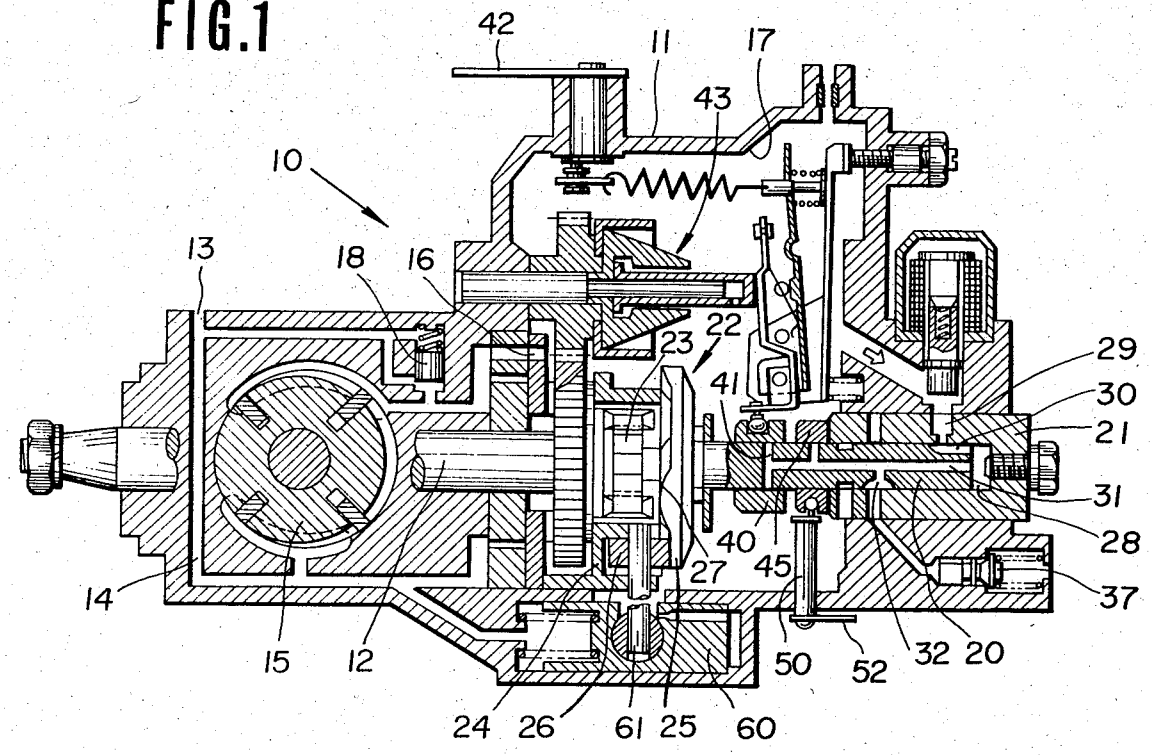
FIG. 1 is a longitudinal section view of a fuel injection pump according to this invention.

With reference to FIG. 1, a fuel injection pump 10 includes a housing 11 into which a drive shaft 12 rotatably extends. The drive shaft 12 is connected to the crankshaft of a diesel engine (not shown) via a coupling (not shown) designed such that the drive shaft 12 rotates at half the speed of rotation of the crankshaft.

The housing 11 is formed with a fuel inlet 13 connected to a fuel tank (not shown) via a fuel feed line (not shown). A fuel transfer passage 14 extends between the fuel inlet 13 and an inlet of a fuel transfer pump 15 disposed within the housing 11. This pump 15 has an outlet connected by another fuel transfer passage 16 to a pump chamber 17 defined within the housing 11. The transfer pump 15 drives fuel from the inlet 13 to the pump chamber 17 via the passages 14 and 16.

The transfer pump 15 is mounted on the drive shaft 12 so as to be driven by the engine. As the engine speed increases, the pressure across the transfer pump 15 increases. A pressure control valve 18 disposed within the housing 11 is connected across the transfer pump 15 to control the pressure across the pump 15.

In FIG. 1, the transfer pump 15 is illustrated in two ways. One is normal. In the other illustration, the pump 15 is rotated through 90° about the vertical.

A plunger 20 located in the pump chamber 17 slidably extends into a barrel 21 supported by the housing 11. The plunger 20 is axially aligned with the drive shaft 12. The plunger 20 is connected to the drive shaft 12 by means of a cam mechanism 22 and a key coupling 23, which are designed to allow the plunger 20 to reciprocate axially and also to rotate as the drive shaft 12 rotates.

The cam mechanism 22 includes a ring 24 and a disc 25 aligned coaxially. The ring 24 supported on the housing 11 carries rollers 26 spaced at equal angular intervals. The disc 25 is formed with cam projections 27 spaced at equal angular intervals. The number of the cam projections 27 as well as the number of the rollers 26 are equal to twice the number of combustion chambers of the engine. The disc 25 is fixed coaxially to the end of the plunger 20 near the drive shaft 12 so that the disc 25 rotates together with the plunger 20. A spring (not shown) urges the disc 25 into engagement with the rollers 26 on the ring 24. As the cam projections 27 pass over the rollers 26 in accordance with rotation of the disc 25, the disc 25 and the plunger 20 reciprocate axially. In this way, as the drive shaft 12 rotates, the plunger 20 reciprocates axially. During one revolution of the drive shaft 12, the plunger 20 reciprocates a number of times equal to twice the number of engine combustion chambers.

The end face of the plunger 20 and the inner surfaces of the barrel 21 define a high-pressure or working chamber 28 within the barrel 21. As the plunger 20 reciprocates axially, the working chamber 28 expands and contracts.

A fuel intake passage 29 extends between the inside of the barrel 21 and the pump chamber 17. The end of the plunger 20 has axial grooves 30 spaced at equal angular intervals. These axial grooves 30 open into the working chamber 28. As the plunger 20 rotates, the fuel intake passage 29 moves into and out of register or communication with each of the axial grooves 30 in turn. As the plunger 20 moves through its expansion stroke, communication between the fuel intake passage 29 and one of the axial grooves 30 is maintained so that fuel can be drawn from the pump chamber 17 into the working chamber 28 via the passage 29 and the groove 30.

The plunger 20 has coaxial passage 31 extending from the working chamber 28. As shown in FIGS. 1, 2, and 3, the plunger 20 has a fuel-distribution radial passage 32, the inner end of which opens into the coaxial passage 31 and the outer end of which opens onto the periphery of the plunger 20.

As best shown in FIG. 3, main fuel-discharge passages 33 extend radially through the walls of the barrel 21 and are spaced at equal angular intervals. The number of these passages 33 is equal to the number of engine combustion chambers. Similarly, pilot fuel-discharge passages 34 extend radially through the walls of the barrel 21 and are spaced at equal angular intervals. The number of these passages 34 is also equal to the number of engine combustion chambers. The main fuel-discharge passages 33 and the pilot fuel-discharge passages 34 are in a common axial position and are spaced alternately with each other at even angular intervals. An outermost portion of the barrel 21 has circumferential grooves 35 extending between adjacent pairs of the main passage 33 and the pilot passages 34. Specifically, each of the circumferential grooves 35 connects a pilot passage 34 to the main passage 33 following the former in the direction of rotation of the plunger 20 indicated by the arrow. A common fuel-discharge passage 36 extends from the outer end of each of the main passages 33 to a corresponding fuel injection nozzle (not shown) via a delivery check valve 37 (see FIGS. 1 and 2). Each of the fuel injection nozzles serves to inject fuel into a corresponding engine combustion chamber. Each of the delivery valves 37 allows fluid flow only in the direction toward the fuel injection nozzle.

As the plunger 20 rotates, the radial passage 32 moves alternately into and out of register or communication with each of the main fuel passages 33 and each of the pilot fuel passages 34. As the plunger 20 moves through its contraction or compression stroke, communication between the radial passage 32 and one of the main and pilot passages 33 and 34 is maintained. During contraction or compression strokes in which the radial passage 32 is in communication with one of the pilot passages 34, fuel is driven out of the working chamber 28 into one of the fuel passages 36 via the coaxial passage 31, the radial passage 32, the pilot passage 34, and the corresponding circumferential groove 35. After passing through this passage 36, fuel is injected into the corresponding engine combustion chamber via the corresponding fuel injection nozzle. As will be clear, this constitutes pilot fuel injection. In the next contraction or compression stroke, the radial passage 32 is in communication with one of the main passages 33 interconnected with the pilot passage 34 described immediately above so that fuel is driven out of the working chamber 28 into the same fuel passage 36 via the coaxial passage 31, the radial passage 32, and the main passage 33. After passing through this passage 36, fuel is injected into the same engine combustion chamber via the same fuel injection nozzle. As will be clear, this is the main fuel injection immediately following the above pilot fuel injection. In subsequent contraction or compression strokes, the radial passage 32 communicates with the succeeding pair of the main and pilot passages 33 and 34 so that the succeeding engine combustion chamber receives pilot and main fuel injections in sequence. The interval between the main fuel injection and the preceding pilot fuel injection in units of crank angle, that is, angular position of the engine crankshaft, directly depends on the angular separation between the interconnected or paired main and pilot passages 33 and 34 as well as on the angular separation between the cam projections 27.

As shown in FIGS. 1 and 4, a main control sleeve 40 disposed in the pump chamber 17 is coaxially mounted on the plunger 20. The main control sleeve 40 is free to slide axially along the plunger 20. A main fuel cut-off port 41 extends diametrically through the plunger 20. The coaxial passage 31 opens into this cut-off port 41. As the plunger 20 moves through its main fuel injection stroke, the main cut-off port 41 is blocked by the main control sleeve 40 at first and is then exposed by the main control sleeve 40 to the pump chamber 17. The blockage of the main cut-off port 41 enables main fuel injection. Upon exposure of the main cut-off port 41 to the pump chamber 17, fuel returns from the working chamber 28 to the pump chamber 17 via the coaxial passage 31 and the cut-off port 41, thereby disabling or interrupting main fuel injection. The axial position of the main control sleeve 40 relative to the plunger 20 determines the effective main fuel injection stroke and thus the total main fuel injection quantity for each main injection stroke.

The main control sleeve 40 is linked to a main control lever 42 and a speed governor 43 so that the axial position of the main control sleeve 40 and thus the main fuel injection quantity can be adjusted via these elements 42 and 43. The main control lever 42 is connected to an accelerator (not shown) so that the angular position of the lever 42 depends on the degree of depression of the accelerator. Since the degree of depression of the accelerator reflects load on the engine, the angular position of the main control lever 42 depends on the engine load. As a result, the axial position of the main control sleeve 40 and thus the main fuel injection quantity depend on the engine load. The governor 43 controls the axial position of the main control sleeve 40 and thus the main fuel injection quantity as a function of the rotational speed of the engine.

A pilot control sleeve 45 disposed in the pump chamber 17 is coaxially mounted on the plunger 20. The pilot control sleeve 45 is free to slide axially along the plunger 20. A pilot fuel cut-off port 46 formed radially in the plunger 20 extends from the coaxial passage 31 to a point on the periphery of the plunger 20. As shown in FIGS. 4 and 5, a radially innermost portion of one end face of the pilot control sleeve 45 is formed with relief grooves 47 spaced at equal angular intervals. The number of these relief grooves 47 is equal to the number of engine combustion chambers. The angular positions of the relief grooves 47 are chosen so that as the plunger 20 rotates, the pilot cut-off port 46 moves into and remains in an angular positional range corresponding to the angular positions of each of the relief grooves 47 in turn during pilot fuel injection stroke. During the main fuel injection stroke of the plunger 20, the pilot cut-off port 46 does not encounter any relief grooves 47 and remains blocked by the pilot control sleeve 45. As a result, the pilot control sleeve 45 and the pilot cut-off port 46 do not affect main fuel injection. The main fuel injection quantity depends solely on the axial position of the main control sleeve 40.

As the plunger 20 moves through its pilot fuel injection stroke, the pilot cut-off port 46 is first blocked by the pilot control sleeve 45 and then encounters one of the relief grooves 47. The blockage of the pilot cut-off port 46 enables pilot fuel injection. Upon engagement of the pilot cut-off port 46 with the relief groove 47, fuel returns from the working chamber 28 to the pump chamber 17 via the coaxial passage 31, the cut-off port 46, and the relief groove 47, thereby disabling or interrupting pilot fuel injection. During this pilot fuel injection stroke of the plunger 20, the main cut-off port 41 is blocked by the main control sleeve 40 at first but is then exposed by the main control sleeve 40 to the pump chamber 17 as in the main fuel injection stroke. The blockage of the main cut-off port 41 enables pilot fuel injection. Exposure of the main cut-off port 41 to the pump chamber 17 disables or interrupts pilot fuel injection. Accordingly, the axial position of the pilot control sleeve 45 relative to the plunger 20 and also the axial position of the main control sleeve 40 relative to the plunger 20 determine the effective pilot fuel injection stroke and thus the total pilot fuel injection quantity for each pilot injection stroke. Specifically, the total pilot fuel injection quantity during each pilot injection stroke is determined by whichever of the main and pilot control sleeves 40 and 45 establishes fuel relief first. In cases where the total pilot fuel injection quantity for each pilot injection stroke is determined by the main control sleeve 40, this total pilot fuel injection quantity is substantially equal to the total main fuel injection quantity for each main injection stroke. In cases where the total pilot fuel injection quantity for each pilot injection stroke is determined by the pilot control sleeve 45, this total pilot fuel injection quantity is smaller than the total main fuel injection quantity for each main injection stroke. Thus, the total pilot fuel injection quantity remains substantially equal to or smaller than the total main fuel injection quantity.

As shown in FIGS. 1, 4, and 6, a shaft 50 rotatably extends through the walls of the housing 11. A sealing ring 58 disposed within the walls of the housing 11 fits around the shaft 50 to prevent fluid leakage. The shaft 50 is connected to the pilot control sleeve 45 by means of a ball 51 eccentrically mounted on the shaft 50 and snugly received in a recess in the sleeve 45. As the shaft 50 rotates, the pilot control sleeve 45 moves axially. One end of a pilot control lever 52 is attached to the shaft 50 so that pivoting the lever 52 causes rotation of the shaft 50. As a result, the angular position of the pilot control lever 52 determines the axial position of the pilot control sleeve 45. As shown in FIGS. 4 and 6, the pilot control lever 52 has an arcuate slot 53 extending concentrically about the axis of the shaft 50. A bolt 54 secured to the walls of the housing 11 extends through the slot 53. Under normal conditions, a nut 55 in engagement with the bolt 54 presses the pilot control lever 52 against a boss 56 of the walls of the housing 11 in order to fix the lever 52 with respect to the housing 11 and to thereby fix the pilot control sleeve 45. This fixed position of the pilot control sleeve 45 determines the maximum value of the total pilot fuel injection quantity.

The fixed position of the pilot control sleeve 45 is adjustable. When the nut 55 is released, the pilot control lever 52 can be rotated easily within a range corresponding to the angular extent of the slot 53. After the pilot control lever 52 and the pilot control sleeve 45 are shifted, tightening the nut 55 enables these elements 52 and 45 to be fixed to the new positions. The adjustable range of the axial position of the pilot control sleeve 45 corresponds to the angular extent of the slot 53.

Returning to FIG. 1, the ring 24 is pivotable about its axis. This ring 24 is connected to a spring-loaded timer piston 60 by means of a rod 61. In the illustration, the timer piston 60 is rotated through 90° about the vertical. As the timer piston 60 moves, the ring 24 pivots. The pressure across the transfer pump 15 is applied across the timer piston 60 via passages (not denoted). Since the pressure across the transfer pump 15 increases with the engine speed, the position of the timer piston 60 depends on the engine speed. Accordingly, the angular position of the ring 24 depends on the engine speed.

As the ring 24 pivots in the direction of rotation of the disc 25, encounter between the cam projections 27 and the rollers 26 is delayed so that timing of main fuel injection stroke as well as timing of pilot fuel injection stroke are retarded. As the ring 24 pivots in the opposite direction, encounter between the cam projections 27 and the rollers 26 advances so that timing of main fuel injection stroke as well as timing of pilot fuel injection stroke also advance. In this way, the angular position of the ring 24 determines the timing of both main and pilot fuel injection strokes. Since the angular position of the ring 24 depends on the engine speed, the timing of both main and pilot fuel injection strokes also depend on the engine speed. Specifically, the timing of both main and pilot fuel injection strokes advance as the engine speed increases.

In the application of this embodiment to a three-cylinder engine, there are six cam projections 27 and six rollers 26 while the number of main fuel-discharge passages 33 and pilot fuel-discharge passages 34 is three. In this case, the interval between main fuel injection stroke and pilot fuel injection stroke is 120° in units of crank angle, that is, angular position of the engine crankshaft. As shown in FIG. 7, the timing of main fuel injection is chosen to be at or around top dead center (TDC) so that timing of pilot fuel injection precedes TDC by an interval of 120° in units of crank angle. Since the crank angle range of 180° immediately prior to each TDC constitutes the compression stroke, pilot fuel injection occurs during this compression stroke, that is, within an acceptable timing range.

In the low engine load range, such as during idling, the main control sleeve 40 determines both of the main and pilot fuel injection quantities so that these quantities are substantially equal to each other as shown by the hatched areas in FIG. 7. Under such conditions in which the main control sleeve 40 determines both of the main and pilot fuel injection quantities, the pilot fuel injection quantity varies in proportion to variations in the main fuel injection quantity and remains substantially equal to the main fuel injection quantity.

In the high engine load range, the main control sleeve 40 determines only the main fuel injection quantity while the pilot control sleeve 45 determines the pilot fuel injection quantity so that the pilot fuel injection quantity remains at the same level, as indicated by the broken curve in FIG. 7, while the main fuel injection quantity exceeds the pilot fuel injection quantity, as indicated by the dotted curve in FIG. 7. The fixed level of the pilot fuel injection quantity is determined by the axial position of the pilot control sleeve 45. In the case of a diesel engine, since the air intake quantity remains at essentially a constant level independent of the engine speed and load, the supply of the fixed injection quantity of pilot fuel is adequate to improve conditions prior to ignition for most engine operating ranges.

The position of the pilot control sleeve 45 may be adjusted by means of an electrically-powered actuator. In this case, the actuator is preferably driven in response to several engine operating conditions, such as the main fuel injection quantity, the engine temperature, and the intake air temperature so that the pilot fuel injection quantity depends on these parameters. SAE Technical Paper Series 800167, corresponding to Japanese Patent Publication 56-101059 and U.S. patent application Ser. No. 225,372 filed on Jan. 15, 1981 and now U.S. Pat. No. 4,470,763, discloses a torque motor which can be used as such an actuator.

What is claimed is:

1. A fuel injection system for an internal combustion engine having a rotatable crankshaft and combustion chambers, comprising:

(a) means defining a working chamber;

(b) means for contracting and expanding the working chamber at a frequency equal to the number of the combustion chamber times the angular frequency of the crankshaft;

(c) means for conducting fuel to the working chamber during each expansion of the working chamber;

(d) means for, during each of alternate contractions of the working chamber, directing fuel from the working chamber toward one of the combustion chambers to inject fuel thereinto at a first timing, the first timing fuel injection being provided to each of the combustion chambers in turn with respect to the order of these alternate contractions of the working chamber; and (e) means for, during each of the intervening contractions of the working chamber, directing fuel from the working chamber toward one of the combustion chambers to inject fuel thereinto at a second timing, the second timing fuel injection being provided to each of the combustion chambers in turn with respect to the order of these intervening contractions of the working chamber, the second timing following the first timing by a fraction of at least one operating stroke of the engine.

2. The system of claim 1, wherein the first timing resides essentially within the compression stroke for each of the combustion chambers and the second timing is around the top dead center for each of the combustion chambers.

3. A fuel injection system for an internal combustion engine having a rotatable crankshaft and combustion chambers, comprising:

(a) means defining a working chamber;

(b) means for contracting and expanding the working chamber at a frequency equal to the number of the combustion chambers times the angular frequency of the crankshaft;

(c) means for conducting fuel to the working chamber during each expansion of the working chamber;

(d) means for, during each of alternate contractions of the working chamber, directing fuel from the working chamber toward one of the combustion chambers to inject fuel thereinto at a first timing, the first timing fuel injection being provided to each of the combustion chambers in turn with respect to the order of these alternate contractions of the working chamber; and (e) means for, during each of the intervening contractions of the working chamber, directing fuel from the working chamber toward one of the combustion chambers to inject fuel thereinto at a second timing, the second timing fuel injection being provided to each of the combustion chambers in turn with respect to the order of these intervening contractions of the working chamber, the second timing following the first timing by a fraction of at least one operating stroke of the engine, further comprising means for increasing the quantity of fuel injected at the first timing to a preset maximum level as the quantity of fuel injected at the second timing increases to a predetermined level and maintaining the first timing fuel quantity at the present maximum level as the second timing fuel quantity increases from the predetermined level.

4. The system of claim 1, further comprising means for adjusting the quantity of fuel injected at the first timing.

5. A fuel injection system for an internal combustion engine having a rotatable crankshaft and combustion chambers, comprising:

(a) a first member coupled to the crankshaft for rotation in accordance with rotation of the crankshaft, the first member having a set of angularly-spaced cam surfaces, the number of which equals twice the number of the combustion chambers;

(b) means, engaging the cam surfaces, for reciprocating the first member in correspondence with each of the cam surfaces as the first member rotates;

(c) a plunger connected to the first member for reciprocation and rotation in accordance with reciprocation and rotation of the first member;

(d) a second member defining a working chamber in conjunction with the plunger, the working chamber contracting and expanding as the plunger reciprocates;

(e) means for conducting fuel to the working chamber as the working chamber expands;

(f) main fuel discharge passages spaced angularly with respect to the plunger and leading to the combustion chambers respectively;

(g) pilot fuel discharge passages spaced angularly with respect to the plunger and leading to the combustion chambers respectively; and (h) a fuel distribution passage formed in the plunger and extending from the working chamber to a point on the periphery of the plunger, the fuel distribution passage communicating with each of the main fuel discharge passages and each of the pilot fuel discharge passages in an alternating sequence as the plunger rotates, the communication between the fuel distribution passage and each of the pilot fuel discharge passages occurring during alternate contractions of the working chamber so that fuel is directed from the working chamber toward each of the combustion chambers in sequence to be injected thereinto at a first timing for each of the combustion chambers, the communication between the fuel distribution passage and each of the main fuel discharge passages occurring during the intervening contractions of the working chamber so that fuel is directed from the working chamber toward each of the combustion chambers in sequence to be injected thereinto at a second timing for each of the combustion chambers, the second timing following the first timing by a fraction of at least one operating stroke of the engine for each of the combustion chambers.

6. The system of claim 5, wherein the first timing resides essentially within the compression stroke for each of the combustion chambers and the second timing is around top dead center for each of the combustion chambers.

7. The system of claim 5, further comprising means for increasing the quantity of fuel injected at the first timing to a preset maximum level as the quantity of fuel injected at the second timing increases to a predetermined level and maintaining the first timing fuel quantity at a preset maximum level as the second timing fuel quantity increases from the predetermined level.

8. The system of claim 5, further comprising means for adjusting the quantity of fuel injected at the first timing.

9. A fuel injection system for an internal combustion engine having a rotatable crankshaft and a combustion chamber;

(a) first means for periodically injecting fuel into the combustion chamber at a first timing with respect to rotation of the crankshaft;

(b) second means for periodically injecting fuel into the combustion chamber at a second timing with respect to rotation of the crankshaft, the second timing following the first timing; and (f) third means for increasing the quantity of fuel injected at the first timing to a preset maximum level as the quantity of fuel injected at the second timing increases to a predetermined level and maintaining the first timing fuel quantity at the preset maximum level as the second timing fuel quantity increases from the predetermined level.

10. The system of claim 9, further comprising means for adjusting the preset maximum level of the first timing fuel quantity.

11. The system of claim 9, wherein the first and second means comprise:

(a) a reservoir supplied with fuel;

(b) a working chamber;

(c) means for contracting and expanding the working chamber as the crankshaft rotates;

(d) means for directing fuel from the reservoir to the working chamber as the working chamber expands;

(e) means for directing fuel from the working chamber to the combustion chamber to inject fuel thereinto at the first timing as the working chamber contracts; and (f) means for directing fuel from working chamber to the combustion chamber to inject fuel thereinto at the second timing as the working chamber contracts;

and wherein the third means comprises:

(a) a first relief passage connecting the working chamber to the reservoir;

(b) means for, during contraction of the working chamber effecting the first timing fuel injection, blocking the first relief passage to enable the fuel injection at first and then opening the first relief passage to disable the fuel injection, and for, during contraction of the working chamber effecting the second timing fuel injection, continuously blocking the first relief passage to continuously enable the fuel injection;

(c) a second relief passage connecting the working chamber to the reservoir; and (d) means for, during contraction of the working chamber effecting each of the first timing fuel injection and the second timing fuel injection, blocking the second relief passage to enable the fuel injection at first and then opening the second relief passage to disable the fuel injection.

12. The system of claim 9, wherein the first and second means comprise:

(a) a reservoir supplied with fuel;

(b) a cylindrical plunger;

(c) means for reciprocating the plunger axially as the crankshaft rotates;

(d) means for rotating the plunger circumferentially as the crankshaft rotates;

(e) means defining a working chamber in conjunction with the plunger, the working chamber contracting and expanding as the plunger reciprocates axially;

(f) means for directing fuel from the reservoir to the working chamber as the working chamber expands;

(g) means for directing fuel from the working chamber to the combustion chamber to inject fuel thereinto at the first timing as the working chamber contracts; and (h) means for directing fuel from the working chamber to the combustion chamber to inject fuel thereinto at the second timing as the working chamber contracts;

and wherein the third means comprises:

(a) a first relief passage extending in the plunger from the working chamber to a point of the periphery of the plunger exposed to the reservoir;

(b) a first control sleeve movably mounted on the plunger and having a relief groove for, during contraction of the working chamber effecting the first timing fuel injection, blocking the first relief passage to enable the fuel injection at first and then opening the first relief passage via the relief groove to disable the fuel injection, and for, during contraction of the working chamber effecting the second timing fuel injection, continuously blocking the first relief passage to continuously enable the fuel injection, the axial position of the first control sleeve determining the preset maximum level of the first timing fuel quantity;

(c) a second relief passage extending in the plunger from the working chamber to a point of the periphery of the plunger exposed to the reservoir; and (d) a second control sleeve movably mounted on the plunger for, during contraction of the working chamber effecting each of the first timing fuel injection and the second timing fuel injection, blocking the second relief passage to enable the fuel injection and then opening the second relief passage to disable the fuel injection.

13. The system of claim 12, further comprising means for releasably holding the first control sleeve to an adjustable axial position.

14. The system of claim 3, wherein the first timing resides essentially within the compression stroke for each of the combustion chambers and the second timing is at the top dead center for each of the combustion chambers.

15. The system of claim 5, wherein the first timing resides essentially within the compression stroke for each of the combustion chambers and the second timing is around the top dead center for each of the combustion chambers.

16. The system of claim 9, wherein the first timing resides essentially within the compression stroke for each of the combustion chambers and the second timing is at the top dead center for each of the combustion chambers.

17. The system of claim 11, wherein the first timing resides essentially within the compression stroke for each of the combustion chambers and the second timing is at the top dead center for each of the combustion chambers.

* * * * *